US005252061A

United States Patent [19]

Ozer et al.

[11] Patent Number: 5,252,061

[45] Date of Patent: Oct. 12, 1993

[54] PULSE COMBUSTION DRYING SYSTEM

[75] Inventors: Richard W. Ozer, Golden Valley, Minn.; Hanford Lockwood, Jr., San Mateo, Calif.; Gregory J. Kimball, Robbinsdale; Ilya Pikus, Plymouth, both of Minn.

[73] Assignee: Bepex Corporation, Minneapolis, Minn.

[21] Appl. No.: 882,048

[22] Filed: May 13, 1992

[51] Int. Cl.[5] ..... F27D 7/00

[52] U.S. Cl. ..... 432/25; 432/58; 34/10; 34/57 R

[58] Field of Search ..... 34/10, 57 A, 57 R, 57 B, 34/201; 432/58, 25; 431/1

[56] References Cited

U.S. PATENT DOCUMENTS 3,508,339 4/1965 Neblett et al. ..... 34/57 B X
4,708,159 11/1987 Lockwood, Jr. ..... 137/340
4,992,043 2/1991 Lockerwood, Jr. ..... 34/57 R

*Primary Examiner*—Henry A. Bennet
*Attorney, Agent, or Firm*—James P. Ryther

[57] ABSTRACT

A system for material drying comprising a pulse combustor and an associated combustion chamber whereby a pulsating flow of hot gases are generated. A tail pipe is connected to the outlet of the combustion chamber for receiving the pulsating flow of hot gases and a material introduction chamber is connected at the outlet of the tail pipe. A drying chamber is connected at the outlet of the material introduction chamber. The hot pulse combustion exhaust gases are cooled to control the temperature of the gases issuing from the outlet of the tail pipe and entering the material introduction chamber. This control is accomplished with a cool air stream issuing into the pulse combustion mixing chamber along with the hot gases from the pulse combustion tail pipe for mixing with and cooling of the hot gases. A separate diluent air stream may be employed for contact with material issuing from the introduction chamber and passing into the drying chamber. This separate diluent air stream will urge material already present in the drying chamber away from the entry location of new material into the drying chamber. The tail pipe may be provided with an inlet end of restricted dimension to act as a venturi with respect to the pulsating stream of hot gases entering the tail pipe from the combustion chamber thereby increasing the sound levels measured at the pulse combustion discharge.

47 Claims, 6 Drawing Sheets

FIG. 1
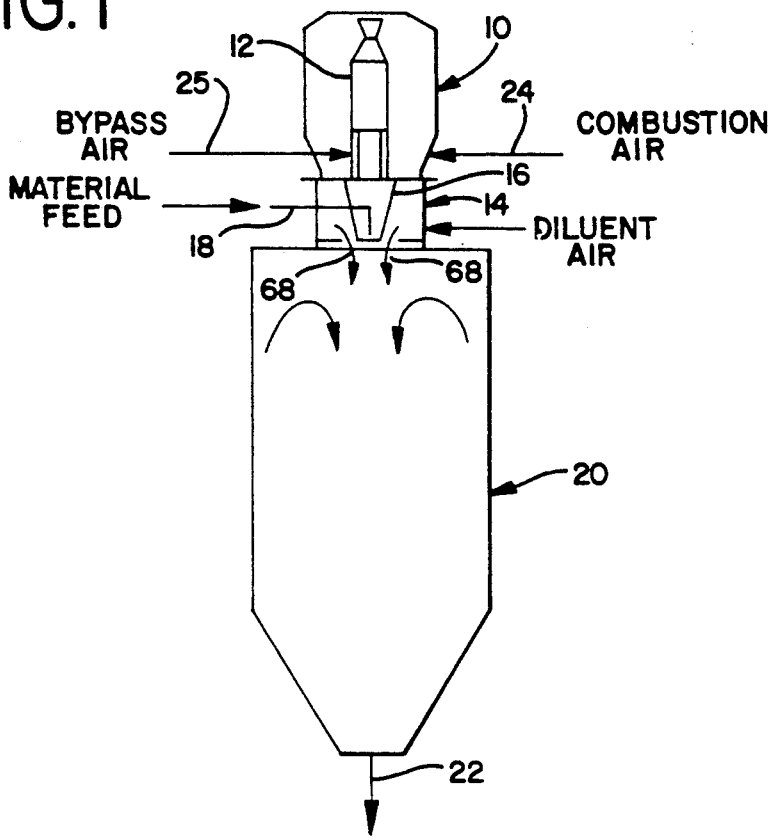
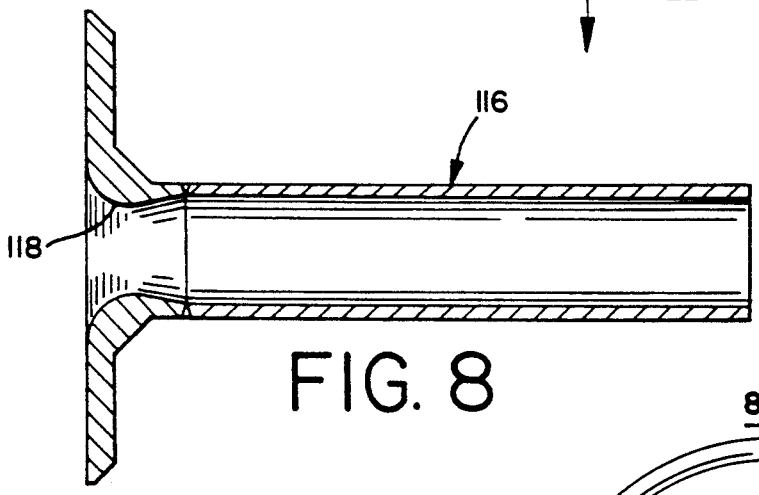
FIG. 8
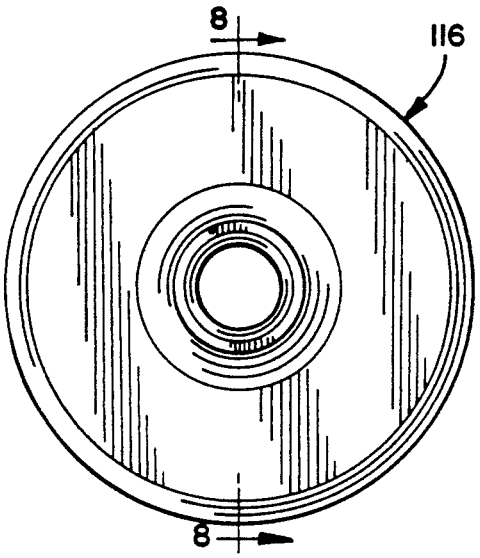
FIG. 7

PULSE COMBUSTION DRYING SYSTEM

BACKGROUND OF THE INVENTION

This invention relates to a system comprising an apparatus and a method for use in drying technology. The invention will be described with reference to the introduction of moist material into the apparatus, the drying of the material, and the collection of the material from a drying chamber. In a typical application, the material entering the apparatus will be in the form of a pumpable solution or slurry, and the system will result in a dry powder exiting from the drying chamber.

The system of the invention more specifically comprises the use of pulse combustion for achieving the drying function. Pulse combustion drying generally relates to the provision of a pulse combustor and associated combustion chamber with fuel being introduced into the combustion chamber. The fuel is mixed with air in the combustion chamber, and this mixture is periodically self-ignited to create high frequency, high energy, sonic pulsations.

More specifically, a tail pipe is associated with the combustion chamber for achieving release of the hot gases from the combustion chamber on a periodic basis. In the operation of such a system, the momentum of the combustion products issuing from the combustion chamber as the result of ignition and explosion will create a reduced pressure in the combustion chamber to draw in a new air and fuel charge which is again self-ignited to achieve the next explosion. The result achieved with a pulse combustor of this type constitutes a pulsating flow of hot gases issuing from the tail pipe. As explained, for example, in Lockwood U.S. Pat. No. 4,708,159, the frequency of pulses may be 100 times per second or higher. It is also well established that the temperature of the products of combustion issuing from the tail pipe will be at least about 1800° F. with temperatures exceeding 2300° F. frequently resulting.

In a typical system, the pulsating flow of hot gases is brought into contact with material introduced to the system at the exit end of the tail pipe. This material, which may be in the form of a slurry, will be "atomized" by the hot gas pulses which results in rapid drying. Under these circumstances, material can be collected as a fine, dry powder.

Difficulties have been recognized with certain types of material when the material is exposed to the high temperatures which characterize pulse combustion drying. Certain materials, for example protein products, may be denatured if exposed to such high temperatures for even a very short amount of time. Other materials may be "scorched" or otherwise damaged due to such exposure.

SUMMARY OF THE INVENTION

This invention relates to an apparatus and method for achieving improved operation of pulse combustion drying systems. The invention involves the use of a pulse combustor and associated combustion chamber for generating a pulsating flow of hot gases. In addition, the invention uses a tail pipe connected at the outlet of the combustion chamber for receiving the pulsating flow of hot gases.

A material feed introduction chamber is connected at the outlet of the tail pipe, and a drying chamber is connected to the introduction chamber. Material introduced into the introduction chamber is contacted by the pulsating flow of hot gases, and the mixture then passes into the drying chamber.

In accordance with one preferred form of the invention, the hot gases entering the introduction chamber from the outlet of the tail pipe are cooled prior to contact with the material entering the material introduction chamber. Specifically, it is preferred that a cool air stream be directed into a mixing chamber positioned at the end of the tail pipe with that stream being brought into contact in that chamber with the hot gases from the tail pipe whereby the temperature of the hot gases will be significantly reduced before contact with the material to be dried. In accordance with this form of the invention, gases heated to a temperature in the order of 1800° F. or greater will be reduced to temperatures in the order of 1400° F. or less by the time of contact with the material to be dried entering the material introduction chamber. This result can be accomplished by mixing the pulsating stream of hot gases in the mixing chamber with a cooler air stream of a temperature in the order of about 400°-500° F.

The cool air stream utilized for reducing the temperature of the hot gases may also be employed for cooling other parts of the pulse combustor. For example, the cool air stream may be directed into an annular spaced surrounding the tail pipe for travel along at least part of the length of the tail pipe prior to mixing with the hot gases issuing from the tail pipe.

In accordance with another feature of the invention, the tail pipe may be designed with a restricted portion adjacent its entry end, and this restricted portion may act as a venturi with respect to the hot gases issuing from the combustion chamber. By employing this venturi action on the pulsating stream of hot gases, the sound levels of gases issuing from the pulse combustor are increased. The atomization and drying efficiencies are thereby improved since a higher sound level will improve the mixing of the hot gases with the material to be dried.

Another important feature of the invention relates to the recognition that the hot gas and atomized material mixture entering the drying chamber can be expected to be at a high temperature relative to material previously introduced to the drying chamber. This aerosol may, therefore, raise the temperature of other material in the chamber to an undesirable level thereby damaging such other material. This problem is avoided by the provision of a stream of air accompanying new material issuing from the material introduction chamber and passing into the drying chamber. This air stream serves to prevent material in the drying chamber from circulating back to the material entry zone of the drying chamber.

BRIEF DESCRIPTION OF THE DRAWINGS

FIG. 1 is a schematic illustration of a system of the type contemplated by this invention;

FIG. 7 is an end view of a modified form of tail pipe adapted to be employed in a system of the type contemplated by this invention;

FIG. 8 is a longitudinal sectional view of the tail pipe taken about the line 8—8 of FIG. 7; and, FIG. 9 is a chart illustrating the relationship of operating temperature and wet and dry bulb temperatures for systems of the type contemplated by this invention.

DETAILED DESCRIPTION OF THE PREFERRED EMBODIMENTS

Figure 2:
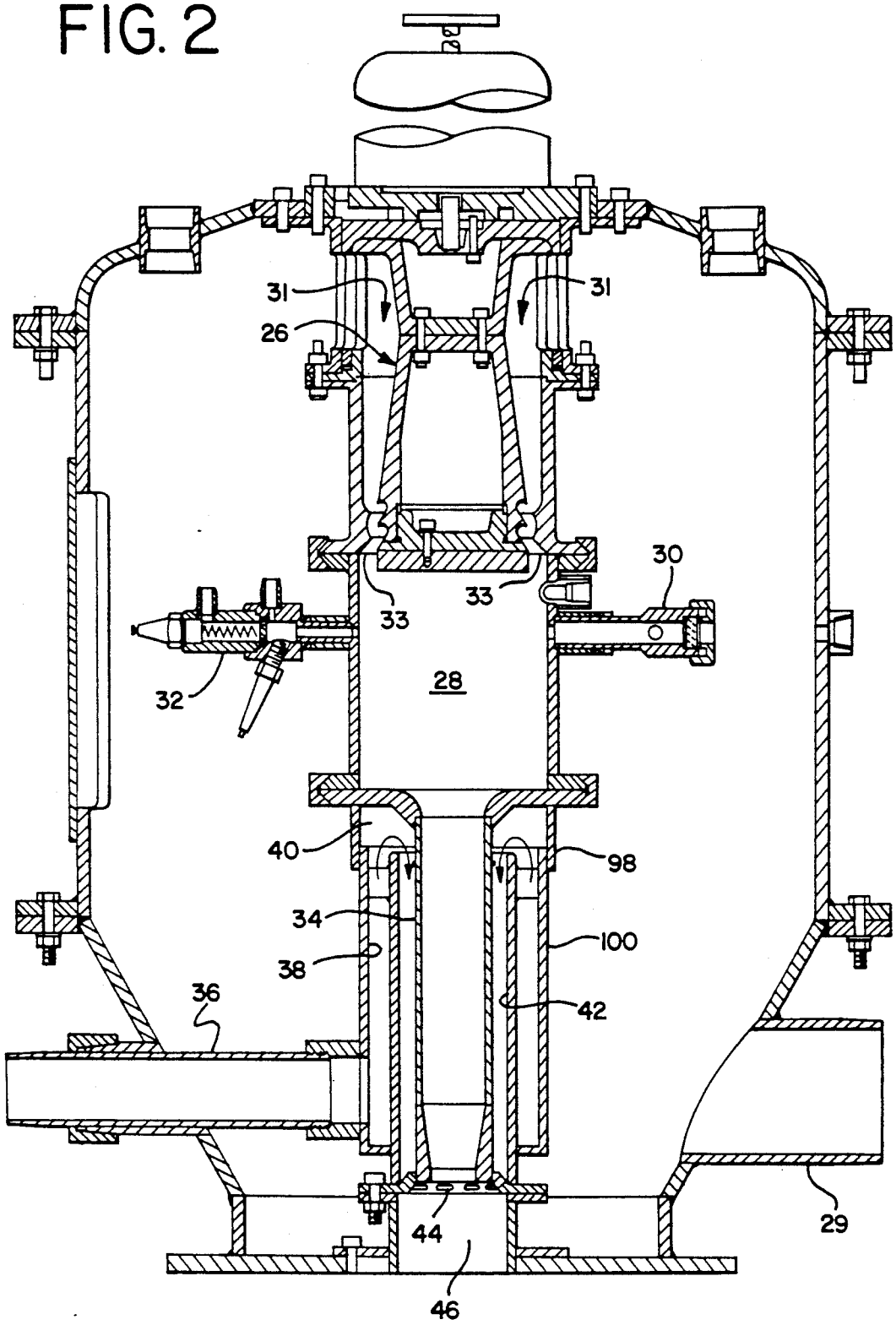
FIG. 2 is a vertical sectional view illustrating the pulse combustor section of the system including the combustion chamber and associated tail pipe and gas mixing chamber.

FIG. 1 provides a schematic illustration of a system of the type incorporating the concepts of this invention. This system comprises an upper housing 10 having a pulse combustor unit 12 including a pulse combustion chamber and tail pipe. An intermediate housing 14 includes a feed introduction chamber 16, and a feed pipe 18 for introduction of solutions or slurries is associated with this chamber.

The lower housing 20 comprises a drying chamber adapted to receive a mixture of material and gases issuing from the feed introduction chamber 16. After a predetermined time of residence in the drying chamber, material will issue from the chamber as indicated at 22 and may be directed to cyclones, bag houses, etc., in accordance with conventional practice. As shown in FIG. 1 at 24, combustion air is fed into the housing 10 for operation of the pulse combustor. As will be explained in detail, this invention also contemplates the introduction of additional air as shown at 25 to achieve certain beneficial results.

FIG. 2 provides an illustration of a system employing a pulse combustor 26 of the type illustrated in the aforementioned Lockwood patent. As described in that patent, a rotary valve system may be employed for periodically feeding the air necessary for supporting combustion in the combustion chamber 28. The air is fed through intake coupler 29, and then through passages 31, 33 communicating with the combustion chamber. The fuel is fed into the combustion chamber through nozzles 30, and an ignitor 32 is employed for achieving initial combustion. A sight port system 35, 37 may be employed for detecting ignition. As explained in the Lockwood patent, once combustion has started, subsequent ignition is achieved by back flow of hot gases into the combustion chamber 28 whereby the ignition becomes self-supporting.

Figure 3:
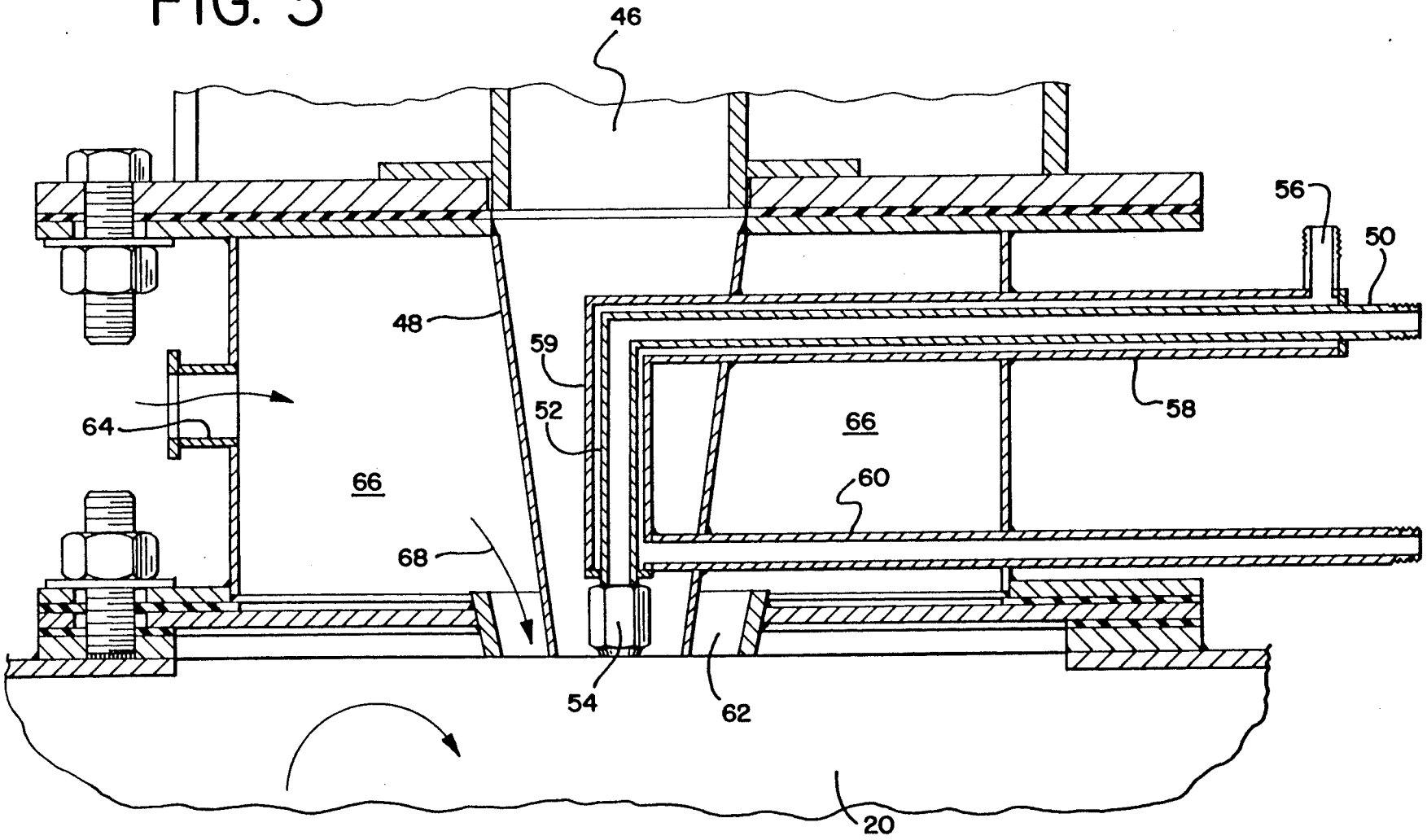
FIG. 3 is an enlarged cross-sectional view illustrating the material introduction chamber for the system.

A tail pipe 34 communicates with combustion chamber 28 for receiving the pulsating flow of gases. A separate air introduction conduit 36 may be provided for introducing air into annular passage 38, and this air is directed as indicated by arrows 40 into annular passage 42 which is in direct surrounding relationship with tail pipe 34. Air from the passage 42 then issues through openings 44 into the mixing chamber 46 which communicates with material introduction chamber 48 (FIG. 3). The pulse combustor air from the tail pipe and the bypass air from openings 44 are mixed in the mixing chamber 46 prior to entering into the material introduction chamber 48.

The material introduction chamber 48 is shown in detail in FIG. 3. A pipe 50 is provided for receiving material to be treated, for example, a slurry of a vegetable protein. This pipe defines a right angle portion 52 and a nozzle 54 may be attached at the end of this portion 52 whereby material to be dried issues in a direction co-current with the hot gas flow entering from mixing chamber 46. An open-ended pipe is normally used with the nozzle 54 being an alternative feature. For most applications it would be more suitable to simply provide the material feed through the open end of feed pipe portion 52.

The material introduction chamber 48 preferably takes the form of a converging cone which tapers inwardly from the end adjacent the outlet of the tail pipe toward the end adjacent the outlet to the drying chamber. This arrangement has been found to enhance complete mixing of the exhaust from tail pipe 34 and the bypass air issuing from openings 44. The converging configuration also minimizies any tendency toward recycling of dry product from the drying chamber into the hot air stream.

A pipe 56 may be attached to pipe 58 which may be positioned in spaced, surrounding relationship with material feed pipe 50 whereby gas or liquid coolant or heating fluid can be continuously employed to influence the temperature of material present in the pipe 50. As illustrated, the pipe 58 may include a portion 59 in surrounding relationship with the portion 52 of pipe 50, and a return portion 60 which permits recirculation of the coolants or heating agents.

The introduction chamber 48 communicates with drying chamber 20. FIG. 3 also illustrates a separate annular passage 62 communicating with the drying chamber. An air inlet opening 64 is provided for delivering air to chamber 66 which surrounds introduction chamber 48. This diluent air, as indicated by the arrows 68 is adapted to flow into the drying chamber 20 along with the mixture of gases and materials passing from the introduction chamber 48 into the drying chamber.

The walls forming the chamber 48, as well as other system parts, will be formed of metal or ceramic materials suited to the high temperature conditions. Most such parts will be impervious to gas flow, however, the walls for chamber 48 may be of porous metal or ceramic material, or of an equivalent perforate design, permitting limited passage of air directly from inlet 64 into chamber 48. This arrangement permits further cooling within chamber 48. In addition, with porous walls or the like, any tendency toward a build-up of material being dried on the interior of the chamber walls will be minimized or eliminated.

As shown in FIG. 1 at 68, the force applied by the additional diluent stream of air assists in preventing material previously introduced into the drying chamber from recirculating to a location close to the entry of any new material entering the drying chamber. This new material and associated gases will be at a relatively high temperature compared to material previously introduced to the drying chamber. By providing the separate streams of air 68 in surrounding relationship to the hot material being newly introduced, the previously introduced material is forced away from the entry location thereby at least minimizing any tendency for overheating and damaging of the previously introduced material.

Figure 4:
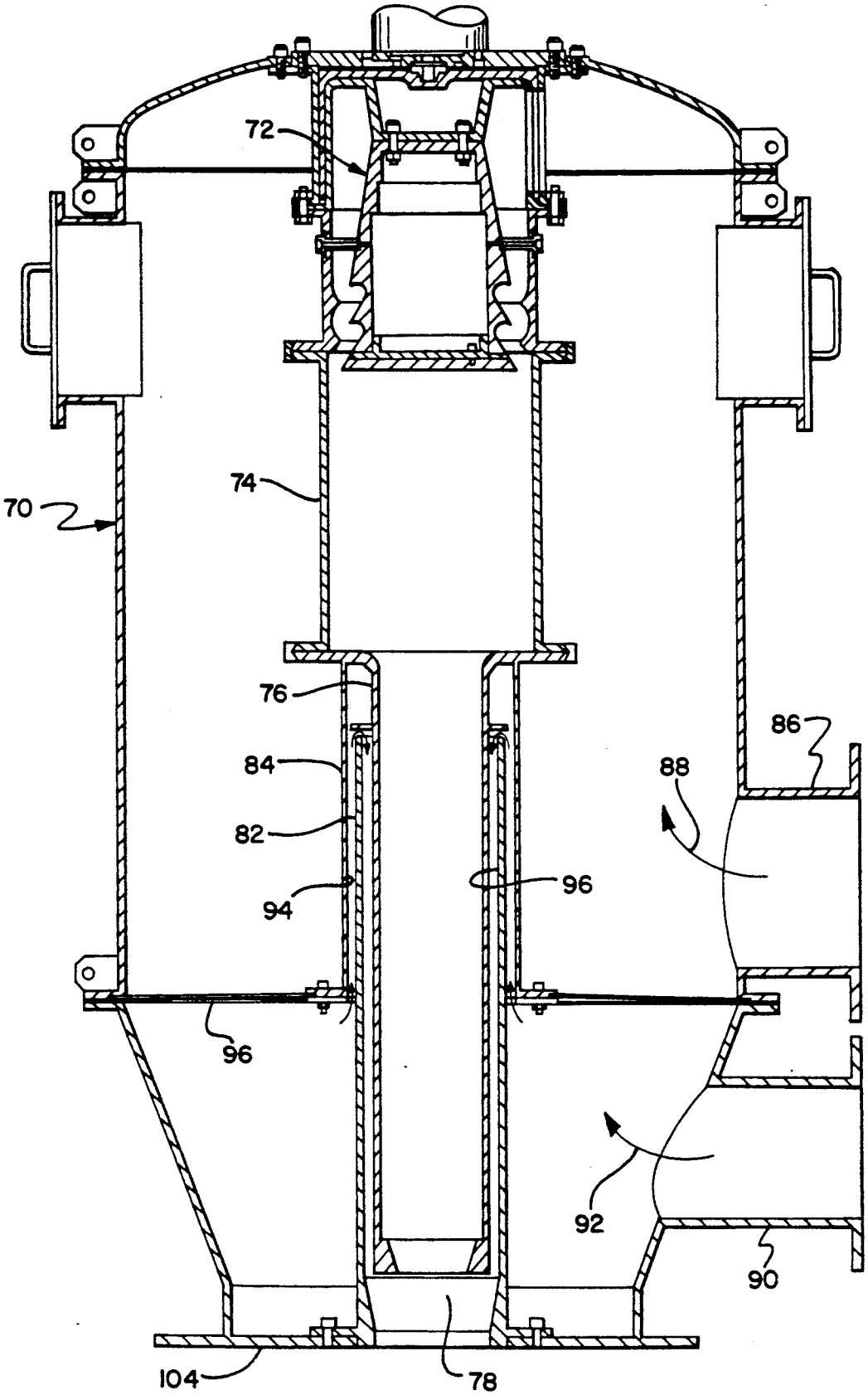
FIG. 4 is a vertical, cross-sectional view illustrating an alternative form of pulse combustor with associated combustion chamber and tail pipe and gas mixing chamber.

FIG. 4 illustrates an alternative form of the invention. In this instance, an upper housing 70 is provided for a rotary valve 72 which is also of the type described in the aforementioned Lockwood patent. A combustion chamber 74 communicates with tail pipe 76 which terminates at the mixing chamber 78 prior to the material feed introduction chamber 80 shown in FIGS. 5 and 6. The tail pipe is surrounded by pipe 82 which is, in turn, surrounded at its upper end by cylindrical enclosure 84.

Air for supporting combustion enters through coupling 86 as indicated by the arrow 88. A separate coupling 90 is provided for introducing a bypass air stream as indicated by arrow 92. This bypass air stream enters through annular passage 94 which is defined between cylinder 84 and pipe 82. This bypass air stream then reverses direction for movement along annular passage 96 which terminates at the mixing chamber 78. With this arrangement, the pulsating flow of hot gases from the combustion chamber 74 is mixed with the bypass air prior to entrance into the introduction chamber 80.

The combustion air entering through coupling 86 is maintained separate from the cool air stream entering through coupling 92 by means of a flexible wall or diaphragm 96. It will be noted that the cylinder 84 is attached to this wall which permits relative movement between the cylinder and pipe 82. Such relative movement is necessary in order to provide allowance for expansion developed in response to thermal and sonic forces which characterize such a system. Similar relative movement is permitted with the embodiment of FIG. 2 wherein the extension 98 of the combustion chamber has a sliding fit relationship with the upper end of the cylinder 100 which is positioned in surrounding relationship with tail pipe 34.

Figure 5:
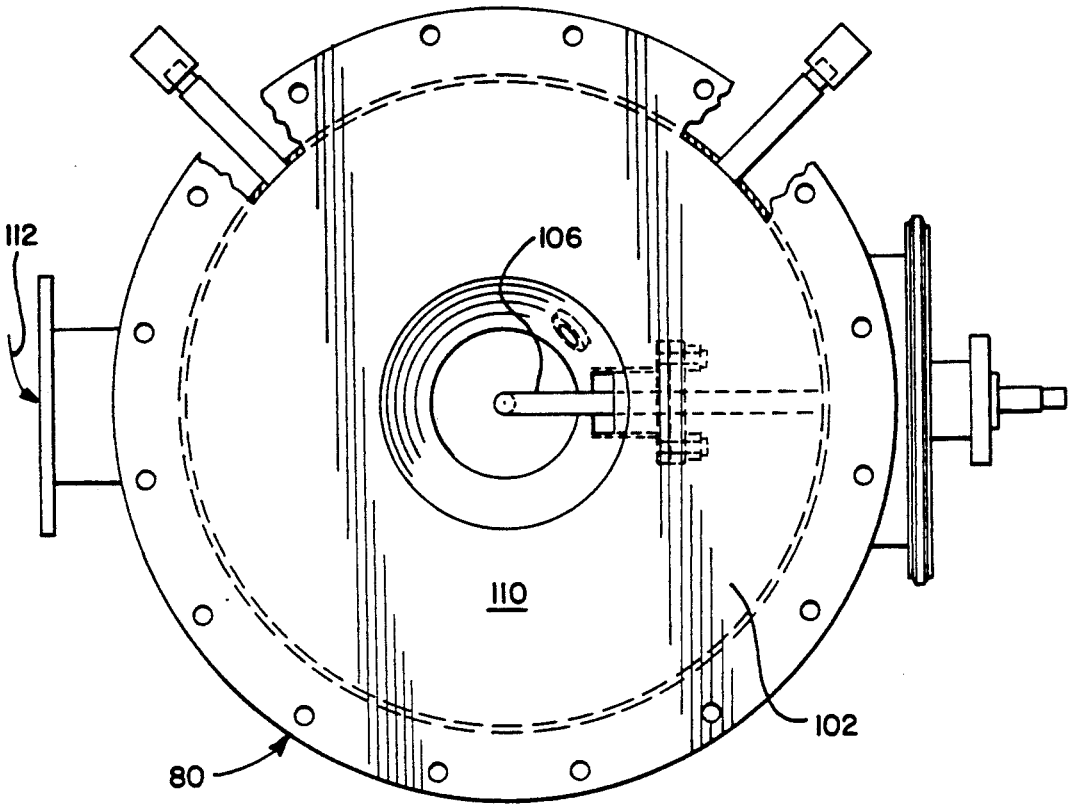
FIG. 5 is a plan view of an alternative form of material introduction chamber utilized in a system of this invention.
Figure 6:
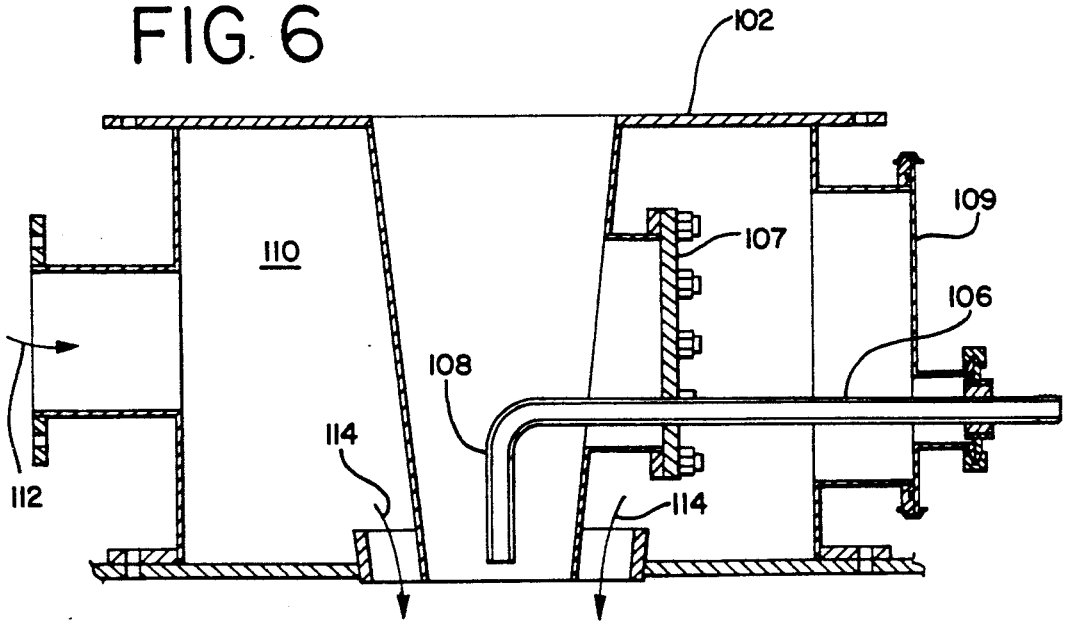
FIG. 6 is a vertical sectional view of a material introduction chamber of the type shown in FIG. 5.

The material feed introduction chamber 80 shown in FIGS. 5 and 6 is located in direct communication with mixing chamber 78. Thus, the plate 102 at the upper end of the introduction chamber is bolted onto the plate 104 which defines the outlet opening of mixing chamber 78.

Material feed pipe 106 extends to chamber 80 through two removable plates 107 and 109 which may be employed for access if clogging should occur. The feed pipe may be characterized by, for example, a right angle bend portion 108 whereby material may be fed into the introduction chamber for movement co-current with the flow of air and hot gases issuing from the tail pipe. Other configurations for this feed pipe are contemplated, for example, to achieve entry at right angles to the gas flow direction. As will be explained in greater detail, the bypass air stream 92 will have diminished the temperature of the hot gases prior to contact with the material to be dried. This material will, therefore, not be exposed to extremely high temperatures when first subjected to the sonic pulses.

A chamber 110 surrounds the introduction chamber, and a separate diluent air stream, as indicated by the arrow 112, can be adapted to enter this chamber. This air stream then exits, as indicated by arrows 114, into the drying chamber, and this additional air stream may act to at least diminish any tendency of previously introduced material to recirculate in the drying chamber back to the area of entry of newly-introduced material.

FIGS. 7 and 8 illustrate a modified form of tail pipe 116 adapted for use in the practice of the invention. It will be noted that this tail pipe defines a restricted entry 118 which is in the form of a venturi. It has been found that the venturi action achieves a pressure gain in the system on the discharge side of the venturi. This has the advantage of producing higher sound levels at the tail pipe exhaust which in turn increases the capabilities of atomization and drying of the system.

Figure 9:
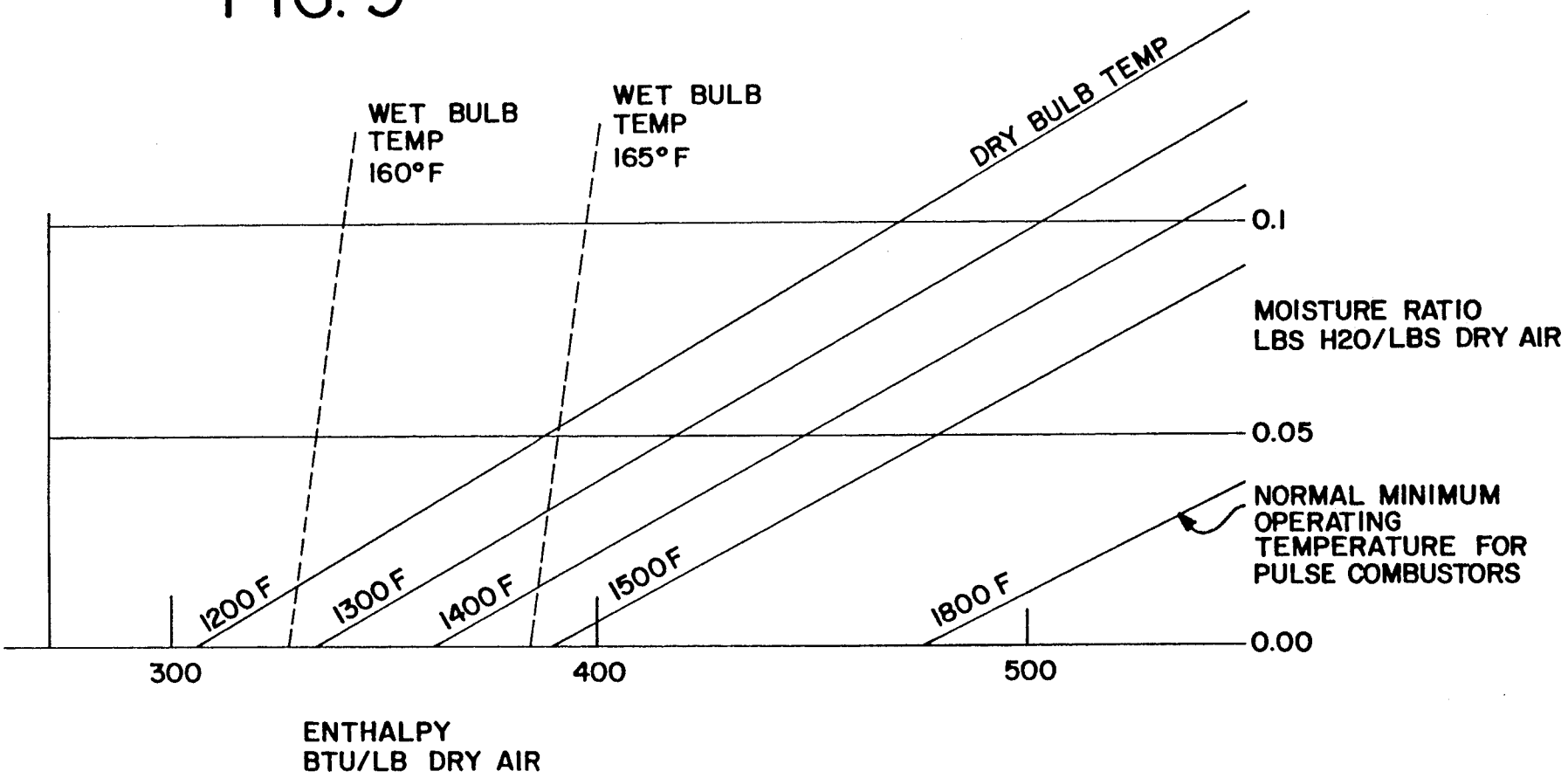

FIG. 9 comprises a graph which shows the relationship of enthalpy, as measured by BTU's per pound of dry air, and the moisture ratio as measured by pounds of water per pounds of dry air. This graph also provides a basis for comparing the dry bulb temperature of material being treated with the wet bulb temperature of the material as these temperatures change with varying conditions.

It is believed that the control of wet bulb temperature, in particular, is of great importance in providing an efficient operation for drying of certain heat sensitive materials which are subject to being damaged in a drying operation where operating conditions are not properly controlled. This theory recognizes the fact that certain materials, for example, vegetable proteins, could be denatured when exposed to excessive temperatures for even very short lengths of time. The theory of operation also recognizes that when a material is being dried, the evaporation of liquid has a cooling effect on the material which enables the material to tolerate high temperature conditions for a limited period of time without damage Thus, this cooling effect should maintain the product temperatures below the point where denaturing of protein occurs. Fundamentally, the system of this invention enables the maintaining of the material being dried at or below the wet bulb temperature for the period of time necessary to remove moisture. When this time period has expired, the practice of the invention is such that the material will have entered a region of the system which is at a low enough temperature that damage to the material will not result.

For some materials, such as a vegetable protein, a wet bulb temperature of 165° F. is recognized. It has also been recognized that where the dry bulb temperature exceeds about 1400° F., it is not possible to maintain the wet bulb temperature at 165° F. or below. Accordingly, the operation of a system in accordance with this invention is conducted with a view toward achieving a temperature for the pulsating gases in the order of 1400° F. or less when those gases come into contact with the solution or slurry of material being fed into the system.

In a typical operation, hot gases entering the tail pipe from the combustion chamber will have a temperature of 1800° F. or higher. In order to reduce the temperature of these gases prior to contact with material being introduced, by-pass air at reduced temperature is introduced. This air would be introduced through pipe 36 in the case of the embodiment of FIG. 2 and through coupling 90 in the case of the embodiment of FIG. 4.

Due to the fact that the by-pass air moves in contact with the hot tail pipe in the embodiments illustrated, this air will issue at the end of the tail pipe at temperatures in the order, for example, of 400°-500° F. The blending and mixing of this cooler air with the pulsating stream issuing from the tail pipe will result in a mixture of gases at a temperature of approximately 1400° F. or less by the time these gases come into contact with material being fed into the system. The evaporative cooling which takes place during drying of the wet material will maintain the material at or below the wet bulb temperature, for example 165° F., during the drying process. By the time this drying has been completed, the material will have entered the lower portions of the drying chamber which is at a substantially lower temperature whereby there is no tendency for the dry material to denature or be otherwise damaged due to exposure at excessive temperatures.

The use of a separate diluent air stream for introduction into chamber 66, in the case of FIG. 3, and chamber 110, in the case of FIG. 6, also serves as a means for maintaining temperature control. In a typical system, this air stream will be introduced, for example, at temperatures between ambient and about 300° F., and the air stream will serve to assist the maintaining of temperatures in the drying chamber at a low enough level to prevent damage to the material being dried. Thus, this additional air stream will dilute the hotter mixture of gases and material issuing from the introduction chamber to thereby lower the temperature and dewpoint of that mixture. As indicated, this diluent air stream, due to its surrounding relationship with respect to the outlet of the introduction chamber, will also physically direct material previously introduced into the drying chamber away from the zone of entrance of new material. Accordingly, the previously-introduced material will not be exposed to higher temperatures after the time that this material has been completely dried.

It will be appreciated that the example relating to a vegetable protein having a wet bulb temperature of 165° F. is generally applicable to most proteins or other temperature-sensitive products. Other products could sustain higher or lower wet bulb temperature, and the operating conditions for the pulse combustor, for example the temperature of the bypass air, can be readily varied to accommodate different product characteristics.

Examples of other materials which can be employed in the practice of the invention are as follows:

Foods and Flavors
- corn syrup, eggs, fish solubles, liver, seasonings, brewers yeast, vegetable proteins Ceramics (Abrasive)
- carbides, ferrites, silica gel Coffee, Teas, Juices
- instant coffee, cocoa, orange juice, tomato juice Pharmaceuticals
- vitamins, antiperspirant, antibiotics, blood, blood plasma, micro-crystalline cellulose Detergents
- soap detergent, sodium orthophosphate Polymers
- E-PVC, emulsifiers, acrylic-latexs, ureaformaldehyde Agrichemicals
- fungicides, pesticides, herbicides Dairy
- coffee whiteners, skim milk, lecithinized milk, malto dextrin, cheese whey, whey protein concentrates, milk replacers Pigments
- dyestuffs, iron oxide, organic dyestuffs In the embodiments of both FIG. 2 and FIG. 4, the bypass air stream introduced for mixing with the hot gases is directed along the length of the tail pipe before this mixing takes place. This cool air stream thus assists in preventing the temperature of the tail pipe from becoming excessively high during the combustion operation. It will be understood, however, that the use of this cool air stream for this purpose is optional and that the concepts of the invention could be achieved without employing this particular arrangement.

It will also be understood that the temperature of gases and air used in the system can be controlled by various means well known in the art. For example, the temperature of the pulsating gas stream issuing from the tail pipe can be varied by varying the operating conditions of the pulse combustor. Similarly, the temperature of bypass air streams introduced into the system can be controlled, and sensors such as thermocouples and pressure gauges can be employed in conjunction with gas control and temperature control valves which may be manually or automatically operated.

It will be understood that various changes and modifications may be made in the above referenced system which provide the characteristics of the invention without departing from the spirit thereof particularly as defined in the following claims.

That which is claimed is:

1. Material drying equipment including a pulse combustor, an associated combustion chamber, means for introducing fuel and combustion air to the combustion chamber whereby the combination of the pulse combustor and combustion chamber generate a pulsating flow of hot gases, a tail pipe connected at that outlet of the combustion chamber for receiving the pulsating flow of hot gases, a material feed introduction chamber connected at the outlet of the tail pipe, a drying chamber connected to the introduction chamber, and cooling means for controlling the temperature of the hot gases issuing from the outlet of the tail pipe and entering the introduction chamber, said cooling means comprising means for delivering a bypass air stream adjacent said introduction chamber, said bypass air stream being separate from the combustion air and issuing into said introduction chamber along with the hot gases for mixing with and cooling the hot gases.

2. Material drying equipment according to claim 1 including a mixing chamber for said hot gases and bypass air stream located between the outlet end of the tail pipe and said introduction chamber.

3. Material drying equipment according to claim 2 including means for directing said bypass air stream into contact with the exterior surface of the tail pipe prior to issuing into the mixing chamber.

4. Material drying equipment according to claim 3 including an annular passage defined around said tail pipe for flow of said bypass air stream, and wherein the end of said annular passage communicates with said mixing chamber.

5. Material drying equipment according to claim 4 including restricted passage means at the end of said annular passage to control the bypass air stream flow into said mixing chamber.

6. Material drying equipment according to claim 4 wherein said annular passage is formed by a pipe of larger diameter than the tail pipe, said larger diameter pipe located in surrounding relationship with the tail pipe.

7. Material drying equipment according to claim 1 including a feed pipe for feeding material to said introduction chamber, and an outlet for the feed pipe positioned to feed material along a path substantially parallel to the flow of hot gases issuing from the tail pipe.

8. Material drying equipment according to claim 7 including nozzle means attached at the end of said feed pipe.

9. Material drying equipment according to claim 7 wherein the outlet for the feed pipe is positioned adjacent the outlet end of the introduction chamber.

10. Material drying equipment according to claim 7 including means for controlling the temperature of the feed pipe.

11. Material drying equipment according to claim 1 including means for delivering a separate diluent air stream into contact with material issuing from the introduction chamber and passing into the drying chamber.

12. Material drying equipment according to claim 11 including means for directing said separate diluent air stream from the introduction chamber into the drying chamber, said separate stream urging material away from the entry location of material into the drying chamber.

13. Material drying equipment according to claim 1 wherein said introduction chamber tapers inwardly from the end adjacent the outlet of the tail pipe toward the end adjacent the outlet to the drying chamber.

14. Material drying equipment according to claim 1 wherein said tail pipe defines an interior passage of substantially uniform diameter from the outlet end to a position adjacent the inlet end of the tail pipe, and wherein said inlet end has a smaller diameter whereby hot gases issuing from the combustion chamber expand within the tail pipe after passage through the smaller diameter inlet end.

15. Material drying equipment according to claim 1 including a feed pipe for feeding material to said introduction chamber, and an outlet for the feed pipe positioned to feed material along a path substantially parallel to the flow of hot gases issuing from the tail pipe.

16. Material drying equipment according to claim 15 including means for directing said bypass air stream into contact with the exterior surface of the tail pipe prior to issuing into the introduction chamber.

17. Material drying equipment according to claim 16 wherein the outlet for the feed pipe is positioned adjacent the outlet end of the introduction chamber.

18. Material drying equipment according to claim 15 including means for delivering a separate diluent air stream into contact with material issuing from the introduction chamber and passing into the drying chamber.

19. Material drying equipment according to claim 18 including means for directing said separate cool air stream from the introduction chamber into the drying chamber, said separate stream urging material previously introduced to the drying chamber away from the entry zone of new material entering the drying chamber.

20. Material drying equipment according to claim 11 including walls defining said introduction chamber, said diluent air stream being directed into contact with said walls prior to contact with said material.

21. Material drying equipment according to claim 20 wherein said walls are porous or perforated whereby part of said diluent air enters said introduction chamber.

22. Material drying equipment including a pulse combustor, an associated combustion chamber, the combination of the pulse combustor and combustion chamber generating a pulsating flow of hot gases, a tail pipe connected at the outlet of the combustion chamber for receiving the pulsating flow of hot gases, a material feed introduction chamber connected at the outlet of the tail pipe, and a drying chamber connected to the introduction chamber, said tail pipe defining an interior passage of substantially uniform diameter from the outlet end to a position adjacent the inlet end of the tail pipe, and wherein said inlet end has a smaller diameter whereby hot gases issuing from the combustion chamber expand within the tail pipe after passage through the smaller diameter inlet end.

23. Material drying equipment according to claim 22 wherein said smaller diameter inlet end comprises a tapering constriction acting as a venturi.

24. A method for operating material drying equipment of the type including a pulse combustor and an associated combustion chamber for generating a pulsating flow of hot gases, a tail pipe connected at the outlet of the combustion chamber for receiving the pulsating flow of hot gases, a material feed introduction chamber connected at the outlet of the tail pipe, and a drying chamber connected to the introduction chamber, said method comprising the steps of introducing fuel and combustion air to the combustion chamber to form said hot gases, directing the hot gas pulses issuing from the outlet of the tail pipe into the introduction chamber, directing a bypass air stream separate from said combustion air into contact with said hot gases prior to entry into said introduction chamber for mixing with and cooling the hot gases, and feeding material to be dried through a feed pipe into the introduction chamber whereby the material is contacted by the mixture of the bypass air stream and hot gases.

25. A method according to claim 24 including the step of directing said bypass air stream into contact with the exterior surface of said tail pipe prior to issuing of said bypass air stream into said introduction chamber.

26. A method according to claim 24 including a feed pipe for feeding material to said introduction chamber, and including the step of feeding material from the feed pipe along a path substantially parallel to the flow of hot gases issuing from the tail pipe.

27. A method according to claim 24 including locating a mixing chamber between the outlet end of said tail pipe and said introduction chamber, and feeding the hot gases and bypass air into said mixing chamber prior to directing the mixture into the introduction chamber.

28. A method according to claim 25 including locating the outlet for the feed pipe adjacent the outlet end of the introduction chamber.

29. A method according to claim 27 including the step of providing means for heating or cooling the feed pipe to control the temperature of material being fed to the introduction chamber.

30. A method according to claim 24 wherein the temperature of the hot gases issuing from said tail pipe is in the order of 1800° F. or greater, the temperature of the bypass air stream contacting said hot gases being at a temperature in the order of about 400°-500° F., whereby said gas mixture contacts said material at temperatures in the order of 1400° F. or less.

31. A method according to claim 24 wherein the temperature of the gas mixture is controlled to maintain the wet bulb temperature of the mixture at about 165° F. or below.

32. A method for operating material drying equipment of the type including a pulse combustor and an associated combustion chamber for generating a pulsating flow of hot gases, a tail pipe connected at the outlet of the combustion chamber for receiving the pulsating flow of hot gases, a material feed introduction chamber connected at the outlet of the tail pipe, and a drying chamber connected to the introduction chamber, said method comprising the steps of introducing fuel and combustion air to the combustion chamber to form said hot gases, restricting the entry of the hot gas pulses into said tail pipe from the combustion chamber, relieving the restriction upon said entry whereby the hot gases expand within the tail pipe, locating a mixing chamber between the outlet end of the tail pipe and said introduction chamber, feeding bypass air separate from said combustion air into said mixing chamber, and simultaneously feeding said hot hot gases into said mixing chamber for blending of the hot gases and bypass air prior to entry into the introduction chamber, directing the expanded hot gas pulses issuing from the outlet of the tail pipe into the mixing chamber, and feeding material to be dried into the introduction chamber and then into the drying chamber.

33. A method according to claim 32 wherein the entry end of said tail pipe acts as a venturi.

34. A method according to claim 32 including locating a mixing chamber between the outlet end of the tail pipe and said introduction chamber, feeding bypass air into said mixing chamber, and simultaneously feeding said hot gases into said mixing chamber for blending of the hot gases and bypass air prior to entry into the introduction chamber.

35. A method for operating material drying equipment of the type including a pulse combustor and an associated combustion chamber for generating a pulsating flow of hot gases, a tail pipe connected at the outlet of the combustion chamber for receiving the pulsating flow of hot gases, a material feed introduction chamber connected at the outlet of the tail pipe, and a drying chamber connected to the introduction chamber, said method comprising the steps of directing the hot gas pulses issuing from the outlet of the tail pipe into the introduction chamber, feeding material to be dried into the introduction chamber, directing the combination of gases and material into the drying chamber, and providing an additional diluent air stream for movement into said drying chamber along with said combination of gases and material, said additional air stream operating to urge material already in the drying chamber away from the vicinity of entry of said combination of gases and material into the chamber.

36. A method according to claim 35 including the step of directing a bypass air stream into contact with said hot gases prior to contact with said material for thereby cooling said hot gases prior to contact with said material, said additional diluent air stream comprising a second and separate air stream directed into contact with the mixture of gases and material issuing from the introduction chamber and passing into the drying chamber.

37. A method according to claim 36 including the step of directing said bypass air stream into contact with the exterior surface of said tail pipe prior to issuing of said bypass air stream into said introduction chamber.

38. A method according to claim 35 wherein said introduction chamber is defined by surrounding air permeable or perforated walls, and including the step of passing part of said diluent air stream through said walls while said material is being fed to said introduction chamber.

39. Material drying equipment including a pulse combustor, an associated combustion chamber, the combination of the pulse combustor and combustion chamber generating a pulsating flow of hot gases, a tail pipe connected at the outlet of the combustion chamber, for receiving the pulsating flow of hot gases, a material feed introduction chamber connected at the outlet of the tail pipe, a drying chamber connected to the introduction chamber, cooling means for controlling the temperature of the hot gases issuing from the outlet of the tail pipe and entering the introduction chamber, said cooling means comprising a bypass air stream issuing into said introduction chamber along with the hot gases for mixing with and cooling the hot gases, a mixing chamber for said hot gases and bypass air stream located between the outlet end of the tail pipe and said introduction chamber, and including means for directing said bypass air stream into contact with the exterior surface of the tail pipe prior to issuing into the mixing chamber.

40. Material drying equipment including a pulse combustor, an associated combustion chamber, the combination of the pulse combustor and combustion chamber generating a pulsating flow of hot gases, a tail pipe connected at the outlet of the combustion chamber for receiving the pulsating flow of hot gases, a material feed introduction chamber connected to the introduction chamber, cooling means for controlling the temperature of the hot gases issuing from the outlet of the tail pipe and entering the introduction chamber, said cooling means comprising a bypass air stream issuing into said introduction chamber along with the hot gases for mixing with and cooling the hot gases, and including means for delivering a separate diluent air stream into contact with material issuing from the introduction chamber and passing into the drying chamber.

41. Material drying equipment including a pulse combustor, an associated combustion chamber, the combination of the pulse combustor and combustion chamber generating a pulsating flow of hot gases, a tail pipe connected at the outlet of the combustion chamber for receiving the pulsating flow of hot gases, a material feed introduction chamber connected to the introduction chamber, cooling means for controlling the temperature of the hot gases issuing from the outlet of the tail pipe and entering the introduction chamber, said cooling means comprising a bypass air stream issuing into said introduction chamber along with the hot gases for mixing with and cooling the hot gases, and wherein said tail pipe defines an interior passage of substantially uniform diameter from the outlet end to a position adjacent the inlet end of the tail pipe, and wherein said inlet end has a smaller diameter whereby hot gases issuing from the combustion chamber expand within the tail pipe after passage through the smaller diameter inlet end.

42. Material drying equipment including a pulse combustion, an associated combustion chamber, the combination of the pulse combustor and combustion chamber generating a pulsating flow of hot gases, a tail pipe connected at the outlet of the combustion chamber for receiving the pulsating flow of hot gases, a material feed introduction chamber connected to the introduction chamber, cooling means for controlling the temperature of the hot gases issuing from the outlet of the tail pipe and entering the introduction chamber, said cooling means comprising a bypass air stream issuing into said introduction chamber along with the hot gases for mixing with and cooling the hot gases, a feed pipe for feeding material to said introduction chamber, an outlet for the feed pipe positioned to feed material along a path substantially parallel to the flow of hot gases issuing from the tail pipe, and including means for directing said bypass air steam into contact with the exterior surface of the tail pipe prior to issuing into the introduction chamber.

43. Material drying equipment including a pulse combustor, an associated combustion chamber, the combination of the pulse combustor and combustion chamber generating a pulsating flow of hot gases, a tail pipe connected at the outlet of the combustion chamber for receiving the pulsating flow of hot gases, a material feed introduction chamber connected to the introduction chamber, cooling means for controlling the temperature of the hot gases issuing from the outlet of the tail pipe and entering the introduction chamber, said cooling means comprising a bypass air stream issuing into said introduction chamber along with the hot gases for mixing with and cooling the hot gases, a feed pipe for feeding material to said introduction chamber, an outlet for the feed pipe positioned to feed material along a path substantially parallel to the flow of hot gases issuing from the tail pipe, and including means for delivering a separate diluent air stream into contact with material issuing from the introduction chamber and passing into the drying chamber.

44. A method for operating material drying equipment of the type including a pulse combustor and an associated combustion chamber for generating a pulsating flow of hot gases, a tail pipe connected at the outlet of the combustion chamber for receiving the pulsating flow of hot gases, a material feed introduction chamber connected at the outlet of the tail pipe, and a drying chamber connected to the introduction chamber, said method comprising the steps of directing the hot gas pulses issuing from the outlet of the tail pipe into the introduction chamber, directing a bypass air stream into contact with said hot gases prior to entry into said introduction chamber for mixing with and cooling the hot gases, feeding material to be dried into the introduction chamber whereby the material is contacted by the mixture of the bypass air stream and hot gases, and directing said bypass air stream into contact with the exterior surface of said tail pipe prior to issuing of said bypass air stream into said introduction chamber.

45. A method for operating material drying equipment of the type including a pulse combustor and an associated combustion chamber for generating a pulsating flow of hot gases, a tail pipe connected at the outlet of the combustion chamber for receiving the pulsating flow of hot gases, a material feed introduction chamber connected at the outlet of the tail pipe, and a drying chamber connected to the introduction chamber, said method comprising the steps of directing the hot gas pulses issuing from the outlet of the tail pipe into the introduction chamber, directing a bypass air stream into contact with said hot gases prior to entry into said introduction chamber for mixing with and cooling the hot gases, feeding material to be dried through a feed pipe and into the introduction chamber whereby the material is contacted by the mixture of the bypass air stream and hot gases, locating a mixing chamber between the outlet end of said tail pipe and said introduction chamber, feeding the hot gases and bypass air into said mixing chamber prior to directing the mixture into the introduction chamber, and providing means for heating or cooling the feed pipe to control the temperature of material being fed to the introduction chamber.

46. A method for operating material drying equipment of the type including a pulse combustor and an associated combustion chamber for generating a pulsating flow of hot gases, a tail pipe connected at the outlet of the combustion chamber for receiving the pulsating flow of hot gases, a material feed introduction chamber connected at the outlet of the tail pipe, and a drying chamber connected to the introduction chamber, said method comprising the steps of directing the hot gas pulses issuing from the outlet of the tail pipe into the introduction chamber, feeding material to be dried into the introduction chamber, directing the combination of gases and material into the drying chamber, providing an additional diluent air stream for movement into said drying chamber along with said combination of gases and material, said additional air stream operating to urge material already in the drying chamber away from the vicinity of entry of said combination of gases and material into the chamber, and including the step of directing a bypass air stream into contact with said hot gases prior to contact with said material for thereby cooling said hot gases prior to contact with said material, said additional diluent air stream comprising a second and separate air stream directed into contact with the mixture of gases and material issuing from the introduction chamber and passing into the drying chamber.

47. A method for operating material drying equipment of the type including a pulse combustor and an associated combustion chamber for generating a pulsating flow of hot gases, a tail pipe connected at the outlet of the combustion chamber for receiving the pulsating flow of hot gases, a material feed introduction chamber connected at the outlet of the tail pipe, and a drying chamber connected to the introduction chamber, said method comprising the steps of directing the hot gas pulses issuing from the outlet of the tail pipe into the introduction chamber, feeding material to be dried into the introduction chamber, directing the combination of gases and material into the drying chamber, providing an additional diluent air stream for movement into said drying chamber along with said combination of gases and material, said additional air stream operating to urge material already in the drying chamber away from the vicinity of entry of said combination of gases and material into the chamber, said introduction chamber being defined by surrounding air permeable or perforated walls, and including the step of passing part of said diluent air stream through said walls while said material is being fed to said introduction chamber.

* * * * *